US005274862A

United States Patent [19]

Palmer, Jr. et al.

[11] Patent Number: 5,274,862

[45] Date of Patent: Jan. 4, 1994

[54] PATIENT TURNING DEVICE AND METHOD FOR LATERAL TRAVELING TRANSFER SYSTEM

[76] Inventors: John M. Palmer, Jr., P.O. Box 115, Lutz, Fla. 33549; John M. Palmer, P.O. Box 823291, Dallas, Tex. 75382

[21] Appl. No.: 884,592

[22] Filed: May 18, 1992

[51] Int. Cl.[5] ..... A61G 7/10

[52] U.S. Cl. ..... 5/81.1; 5/600

[58] Field of Search ..... 5/81.1-89.1, 607, 600

[56] References Cited

U.S. PATENT DOCUMENTS 4,109,329 8/1978 Tupper ..... 5/84.1
4,536,903 8/1985 Parker ..... 5/81.1
4,675,925 6/2987 Littleton ..... 5/81.1
4,872,226 10/1989 Lonardo ..... 5/81.1
4,944,053 7/1990 Smith ..... 5/81.1
5,168,587 12/1992 Shutes ..... 5/88.1

*Primary Examiner*—Alexander Grosz

[57] ABSTRACT

A fabric device (50) useful in turning over a patient (60) while lying on a bed (22) equipped with a lateral traveling transfer system (30) or bedside pulling device (70). The fabric device (50) consist of a middle section (52) on which a patient (60) lays. A strap or straps (54) on each side of the patient (60) are disposed over the patient's torso (62) and are attached to the handrails (40) or the bedside pulling means (70) on the opposite side of the bed (22). Lateral movement of the torso (62) in one direction and the pulling by the straps (54) in the opposite direction creates the turning action.

4 Claims, 3 Drawing Sheets

FIG. 3
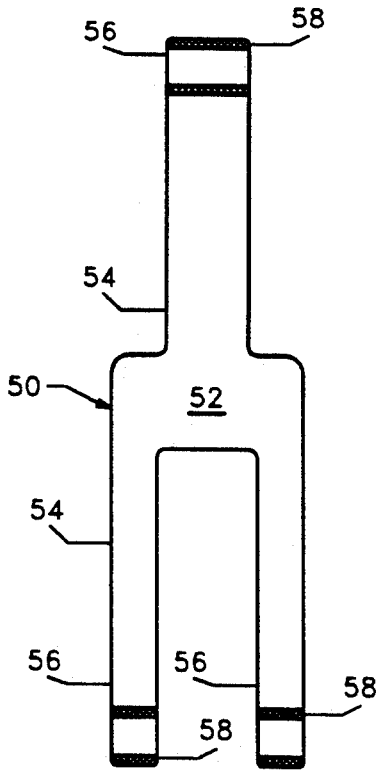
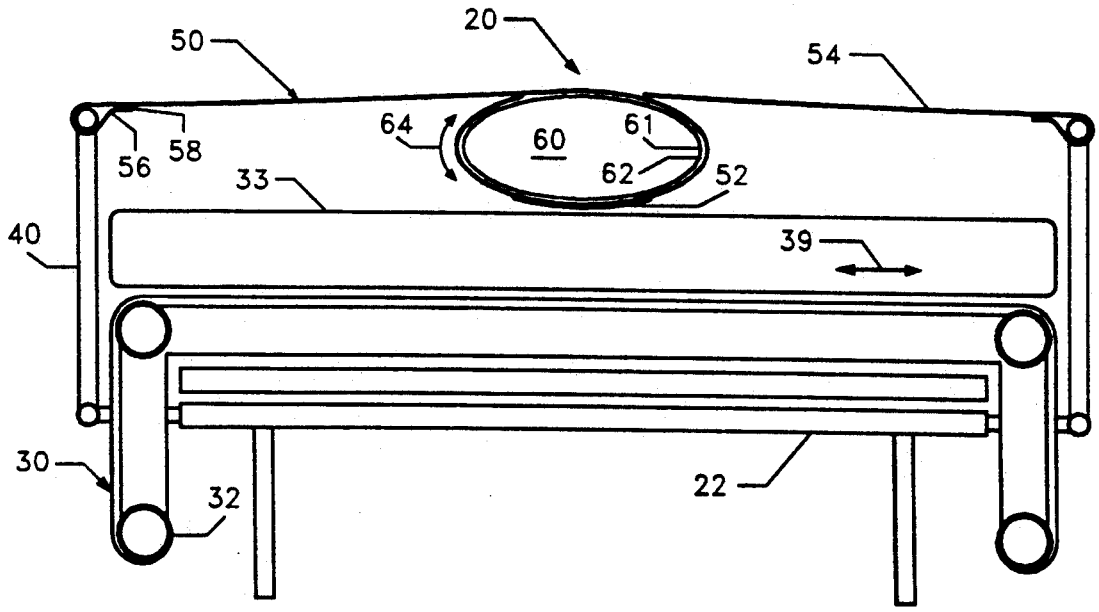
FIG. 4

PATIENT TURNING DEVICE AND METHOD FOR LATERAL TRAVELING TRANSFER SYSTEM

BACKGROUND—FIELD OF INVENTION

Persons who are bed-ridden are subjected to disease due to inactivity and lying in a supine position for prolonged intervals. Caregivers are required to alleviate this problem by repositioning patients on their sides and stomach part of the time as many patients are unable to turn over by themselves.

Devices which facilitate repositioning patients are disclosed in prior patents. For example, U.S. Pat. No. 4,109,329 describes a device comprising a bed or similar device which includes a loop of flexible material wide enough to hold the supine patient. The loop of material is driveable in the loop direction so that the patient moves in the loop direction. This device is quite bulky and will be in a caregivers way during routine treatment of the patient. It also induces a considerable amount of compression on the patient when in use. An attendant is required for its use.

U.S. Pat. No. 4,536,903 describes a fabric device including hand grip means extending laterally outward from each side. Either hand grip means is disposed over the torso of the patient and an attendant pulls to turn the patient then latches it to a handrail to hold him or her in place. This is a nonpowered device that requires an attendant for every change of the patients position. In U.S. Pat. No. 4,944,053 a slip device of fabric aids in the turning over process, it also is nonpowered, and requires an attendant for turning over the patient.

Other patents disclose relatively complex devices which are useful in manipulating immobile persons. Many are expensive and space consuming. Some require so much of a caregiver's time for setting up and sanitizing they are not practical. Thus the age old tradition of turning over a patient every two hours by hand prevails and decubitus management for the immobile patient remains a serious problem.

OBJECTS AND ADVANTAGES

In many circumstances, patients lack the strength and dexterity to effect their own movement. It would be desirable to provide such a person with a device for facilitating the turning movement by activating a hand held pendant, voice, sight, or foot controller, or automatically by a programmed controller.

It is therefore a primary objective of the present invention to provide a device for turning over a patient that operates in conjunction with a lateral traveling transfer system, as in this inventor's U.S. patent application Ser. No. 07/817,333 which can be effortlessly activated in many ways, or completely automated.

Another object is to provide a device that will turn over a patient while the lateral traveling transfer system moves him or her to a selected location on the bed. For a patient already having access to a bed equipped with a lateral traveling transfer system the device of this invention is very inexpensive.

Still another object of the present invention is to provide a device to facilitate patient turning without the use of a lateral transfer system. In this embodiment the same turning devise is used but a bed side pulling system provides the lateral movement.

DRAWING FIGURES

FIG. 3 is a plan view of a patient turning device.

FIG. 4 is a sectional elevation view of FIG. 1 at 10—10.

REFERENCE NUMERALS IN DRAWINGS

1–6 Figs.
10–12 sections thru Figs.
20–20' preferred embodiments
22–26 bed with conveyor, bed without conveyor
30–39 lateral traveling transfer system
40 handrails
50–58 turning device
60–62 patient
64–66 turning process
70–74 bed side pulling device

DESCRIPTION OF THE INVENTION

Figure 1:
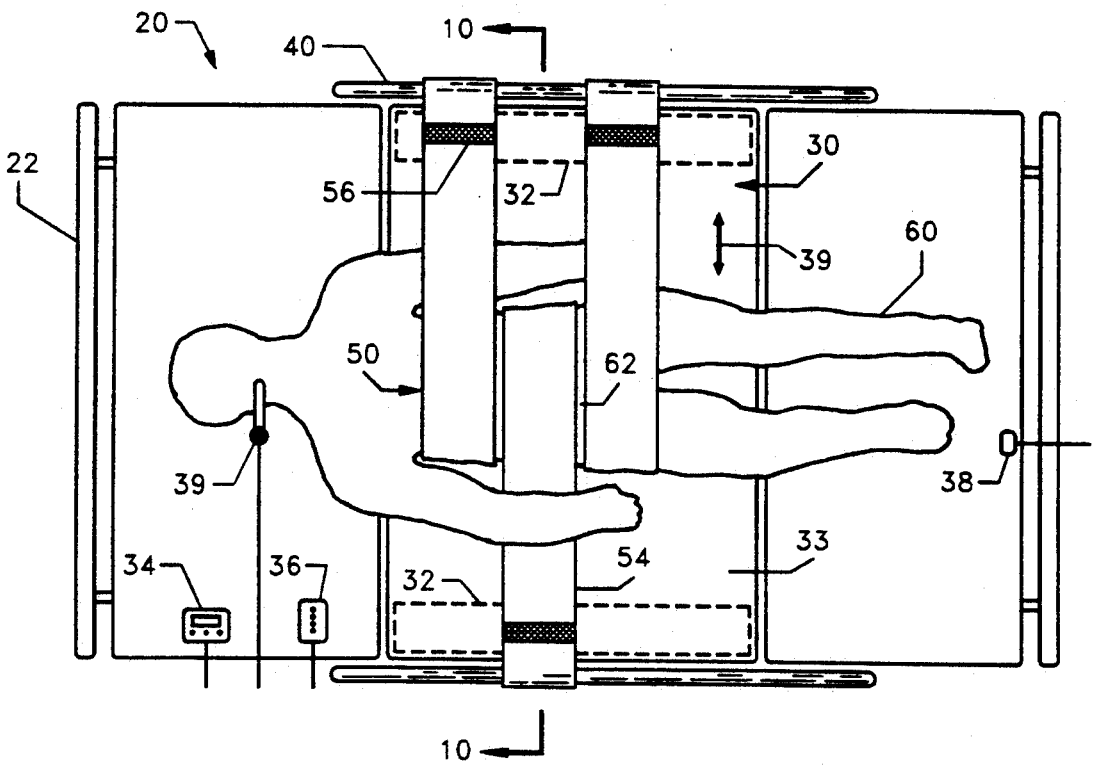
FIG. 1 is a plan view of a patient turning device with a patient lying supine in it on a bed equipped with a lateral traveling transfer system.

A preferred embodiment 20 of the present invention is illustrated in FIG. 1 (plan view). Patient 60 is shown lying on hospital bed 22 having a lateral traveling transfer system 30 under his or her torso. Drive rollers 32 move the laterally traveling mattress 33 back and forth across 39 bed 22. Free ends 56 of turning device 50 straps 54 fitted with hook and loop releasable fasting means 58 (FIG. 3) are shown attached to handrails or other securing means 40. Turning device middle section 52 (FIG. 3) underlies torso 62 when patient 60 lies supine on it. Also shown are various instruments for activating the lateral traveling transfer system, a programmable controller 34, a hand held pendant 36, a foot button 38 and a mouth or voice controller 39. 10—10 shows the cut line of FIG. 4.

Figure 2:
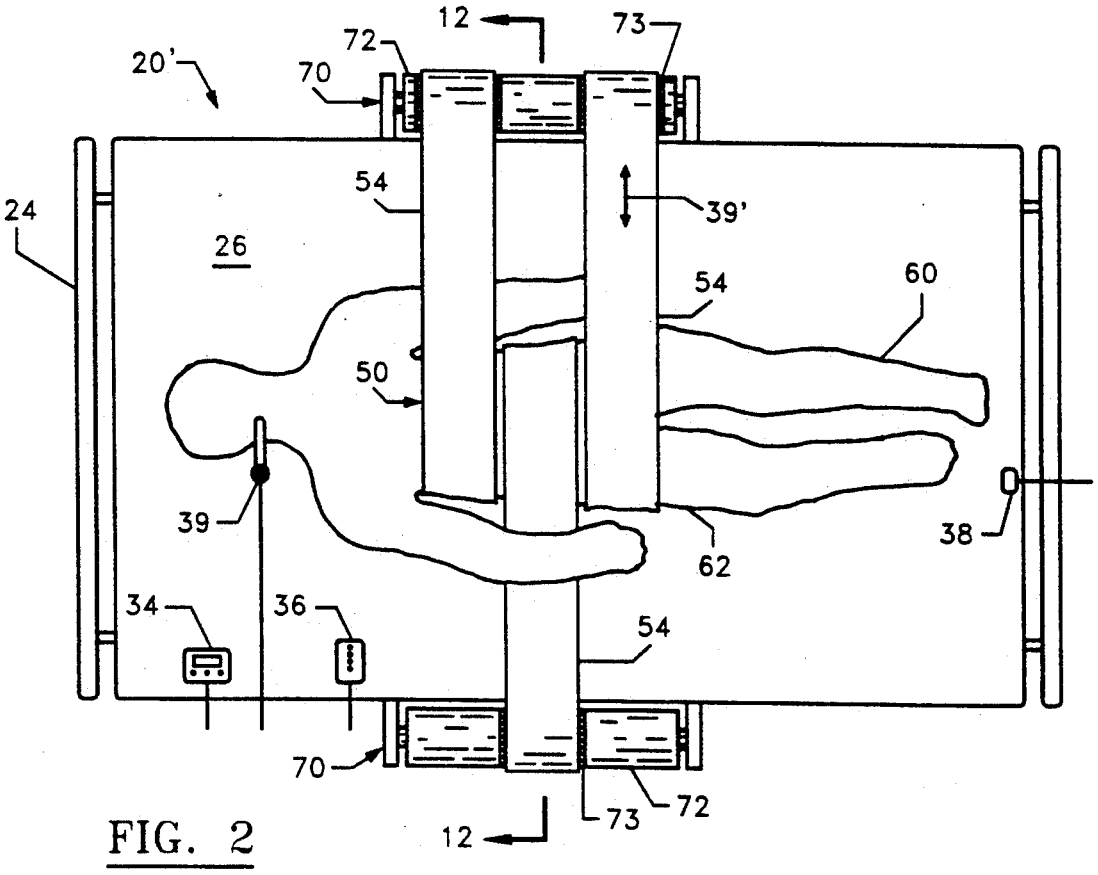
FIG. 2 is a plan view of a patient turning device with a patient lying supine in it on a bed equipped with a bed side pulling device.

FIG. 2 shows in embodiment 20' turning device 50 being used with a patient 60 lying on a bed 24 that does not have a lateral traveling transfer system. Mattress 26 shown is for a conventional flat bed. In this arrangement the lateral movement 39' creating the turning process 66 (FIG. 5) is provided by bedside pulling device 70 on each side of the bed 24. The drive rollers 72 have releasable attaching surfaces 73 for receiving the releasable attaching surfaces 58 of straps 54. 12—12 shows the cut line of FIG. 5.

In FIG. 3 the turning device 50 is shown with straps 54 extending outwardly from middle section 52 and free ends 56 with releasable attaching surfaces 58. The straps 54 on one side of middle section 52 are located in a staggered relationship to those on the other side. This allows them 54 to bypass each other when disposed over a patient 60 for attaching to handrails 40 or bed side pulling device 70. In some cases it might be advantageous to releasably attach the straps 54 to middle section 52. For the turning device 50 to turn a patient 60 from the supine position to a face down position middle section 52 should be approximately the width of or less than the width of the patient's torso 62. For turning a patient 60 from only the supine to his or her side, middle section 52 may be increased in width by an amount sufficient to reach the midpoint 61 of the sides of torso 62 (FIG. 4 and 5).

Embodiment 20 is shown in FIG. 4 with lateral traveling transfer system 30 traveling mattress 33 moving in either direction 39 causing patient 60 to be turned over 64 due to the restraint over the torso 62 by turning device 50 straps 54.

Figure 5:
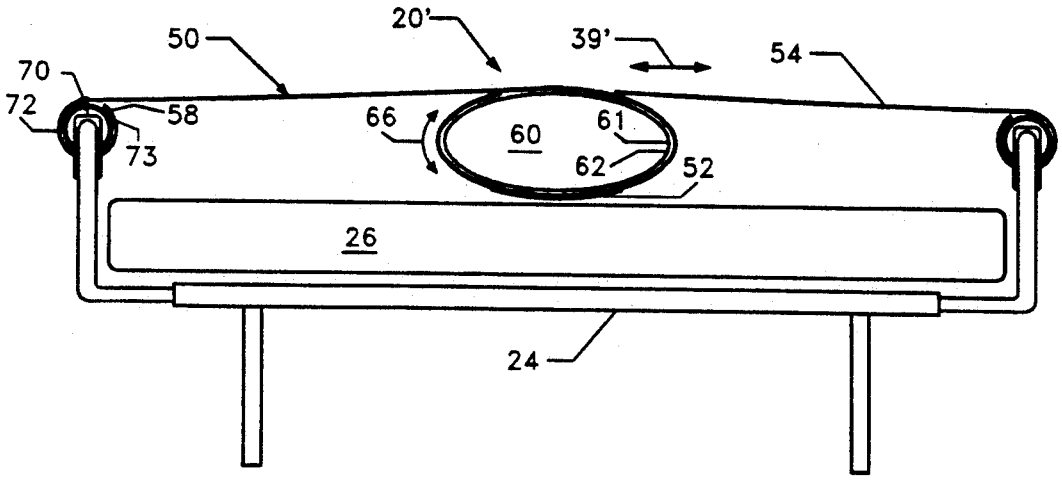
FIG. 5 is a sectional elevation view of FIG. 2 at 12—12 showing a bedside pulling device.

FIG. 5 shows embodiment 20' in sectional elevation a view taken at 12—12 of FIG. 2. This is an alternate source for lateral movement installed on bed 24 having a bed side pulling device 70. In this embodiment the straps 54 are pulled 39' creating the turning process 66 while mattress 26 remains stationary. Pulling device 70 may have powered rollers 72 with releasable attaching surfaces 73 for receiving the releasably attaching surfaces 58 of straps 54 or it may have lineal pulling equipment located on the side or underneath the bed. Turning 66 of patient 60 in this embodiment is effected by the pulling of straps 54 to either side of bed 24 by pulling device 70.

Figure 6:
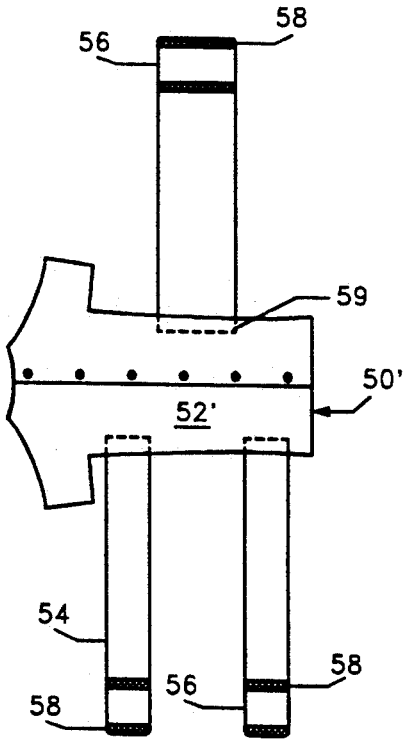
FIG. 6 is a plan view of a bed garment turning device including straps.

FIG. 6 shows an alternate sling arrangement 50' to that in FIG. 2. Sling straps 54 may be either permanently secured or releasably secured to bed garment 52' at points 59 which are on the side or the back of the garment.

Various methods of activation of the turning device may be required depending on the condition of the patient. Hand held pendant 36 (FIG. 1) may be preferred by a caregiver while helping with a patient turn over. Foot 38 or voice 39 controllers may be used by a patient unable to use his or her hands. A programmable controller 34 may be desirable for a patient requiring long term unattended turning.

Preferred embodiments and variants have been suggested for this invention. Other modifications may be made, as by adding, combining, deleting, or subdividing components, parts, or steps, while retaining all or some of the advantages and benefits of the present invention — which is defined in the following claims.

We claim:

1. A device for turning over a patient lying on a bed equipped with either a lateral traveling transfer system or a bed side pulling means comprising;

a flexible middle section made of fabric or laminate of a size to approximately underlie the torso of the patient, the middle section having a first side edge oriented toward a first side of the bed and a second side edge oriented toward a second side of the bed;

one or more straps extending laterally outward from the first side edge, the first side edge strap or straps having a first free end or ends, said first free end or ends having releasable attaching means for attaching to a handrail or bed side pulling means on the second side of the bed;

a plurality of straps extending laterally outward from the second side edge, the second side edge straps having second free ends, said second free ends having releasable attaching means for attaching to a handrail or bed side pulling means on the first side of the bed;

the first side edge strap or straps and the second side edge straps located on the middle section in a staggered relationship so that they bypass each other when disposed over the torso of the patient and attached to the handrails or bed side pulling means.

2. A device for turning over a patient lying on a bed equipped with a lateral traveling transfer system or a bed side pulling means as defined in claim 1, wherein the middle section comprises a pajama jacket or other bed garment and the straps are attached to the back or sides of the pajama jacket or bed garment.

3. A method of using a device for turning over a patient lying on a bed equipped with a lateral traveling transfer system, said method comprising:

providing a bed equipped with a lateral traveling transfer system, said bed having a first side handrail and a second side handrail;

providing a turning device, said device having a first strap or straps with a first free end or ends and second straps with second free ends extending outwardly from a middle section, said free ends having releasable attaching means;

placing the device on the bed with the first free end or ends oriented toward the first handrail and with the second free ends oriented toward the second handrail;

placing the patient on the device so that the middle section underlies the patient's torso;

disposing the first strap or straps over the patient's torso and attaching the first free end or ends to the second side handrail;

disposing the second straps over the patient's torso and attaching the second free ends to the first side handrail;

activating the lateral traveling transfer system moving the underside of the patient's torso across the bed, said patient being turned over due to the restraint of the turning device over said patient's torso.

4. A method of using a device for turning over a patient lying on a bed equipped with a bed side pulling means, said method comprising:

providing a bed equipped with a first side pulling means and a second side pulling means;

providing a turning device, said device having a first strap or straps with a first free end or ends and second straps with second free ends extending outwardly from a middle section, said free ends having releasable attaching means;

placing the device on the bed with the first free end or ends oriented toward the first side pulling means and with the second free ends oriented toward the second side pulling means;

placing the patient on the device so that the middle section underlies the patient's torso;

disposing the first strap or straps over the patient's torso and attaching the first free end or ends to the second side pulling means;

disposing the second straps over the patient's torso and attaching the second free ends to the first side pulling means;

activating the first side pulling means for turning the patient toward said first side turning means, and activating the second side pulling means for turning the patient toward said second side pulling means.

* * * * *